OVERHEAD CAMSHAFT ENGINE

BACKGROUND OF THE INVENTION

1. Field of the Invention

This invention relates to an improvement in overhead camshaft engines, and more particularly to a cylinder head configuration for preventing noise generation from the vicinity of a camshaft.

2. Description of the Prior Art

In connection with overhead camshaft engines, a camshaft is rotatably supported by a plurality of aligned cam brackets which are located on a cylinder head. However, the cam brackets unavoidably vibrate in various directions due to camshaft rotation and charge explosion or combustion. This causes vibration of the cylinder head and a rocker cover installed on the cylinder head, creating high levels of noise therefrom.

BRIEF SUMMARY OF THE INVENTION

In accordance with the present invention, an overhead camshaft engine comprises a cylinder head secured to a cylinder block. A plurality of cam bracket members are disposed on the cylinder head to rotatably support a camshaft on the cylinder head. Additionally, at least a beam member is secured to the cam bracket members to securely connect the cam bracket members with each other. In the thus configurated engine, the cam bracket members can be prevented from various vibrations thereof, thereby effectively reducing noise emission from the engine.

BRIEF DESCRIPTION OF THE DRAWINGS

The features and advantages of the engine according to the present invention will be more clearly appreciated from the following description taken in conjunction with the accompanying drawings in which like reference numerals designate like parts and elements, and in which.

DETAILED DESCRIPTION OF THE INVENTION

Figure 1:
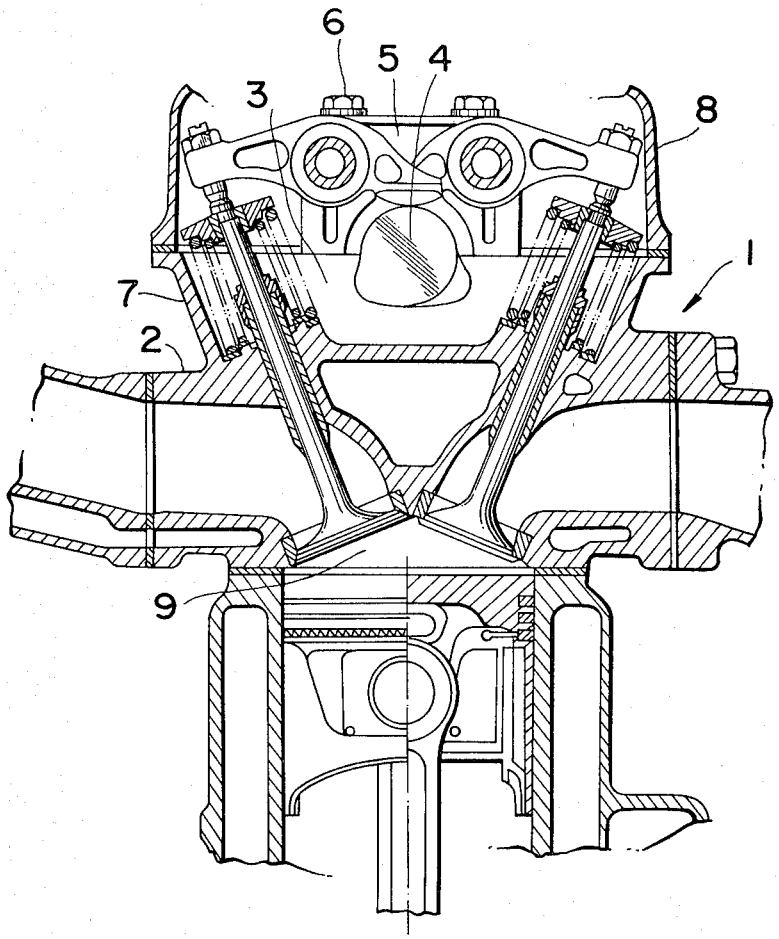
FIG.1 PRIOR ART
FIG. 1 is a vertical cross section of a conventional overhead camshaft engine.

To facilitate understanding the present invention, a brief reference will be made to an example of conventional single overhead camshaft engines, depicted in FIG. 1 Referring to FIG. 1, the conventional engine 1 is provided with hemispherical combustion chambers which are higher in thermal efficiency because they are higher in combustion rate and lower in the ratio of surface area/volume. The engine 1 includes a cylinder head 2 which is formed by casting an aluminum alloy or the like. The cylinder head 2 is integrally formed at its top surface with a plurality of bearing sections 3 for a camshaft 4. Additionally, a plurality of cam brackets 5 are secured onto the bearing sections 3, respectively, by means of bolts 6, so that the camshaft 4 is rotatably supported by the thus associated bearing sections 3 and the cam brackets 5. The plurality of bearing sections 3 are connected with each other by means of overhung is side walls 7 in such a manner that the bearing sections 3 are aligned along the axis of the engine 1.

However, the thus arranged conventional engine has encountered the following problems: The cam brackets 5 tend to readily vibrate in fore-and-aft direction or camshaft axial direction, torsional direction etc. by vibrations induced by the rotations of the camshaft 4 and the explosion of a charge in a combustion chamber 9. This excites the cylinder head 2 and a rocker cover 8, thereby emitting high levels of noise. Additionally, the above-mentioned side walls 7 serve to improve the flexural rigidity of the cylinder head 2 in upward-and-downward direction; however, these side walls 7 themselves vibrate to a considerable extent, thus emitting noise therefrom while increasing vibration inducing forces to the rocker cover 8.

Figure 2:
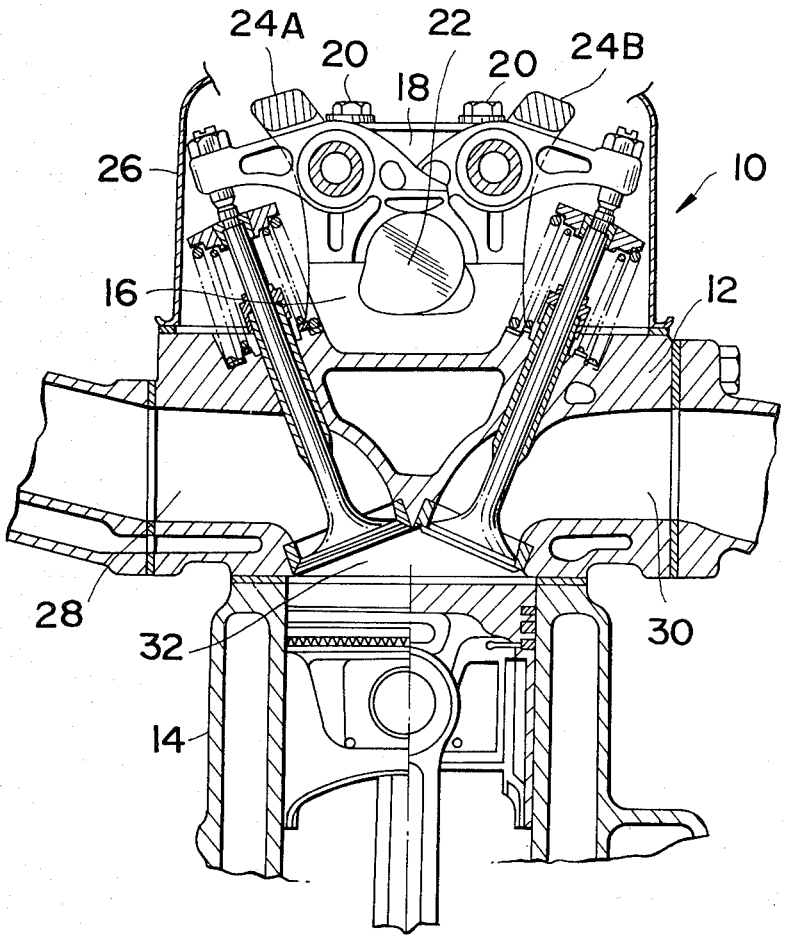
FIG. 2 is a vertical cross section of a preferred embodiment of an overhead camshaft engine in accordance with the present invention.
Figure 3:
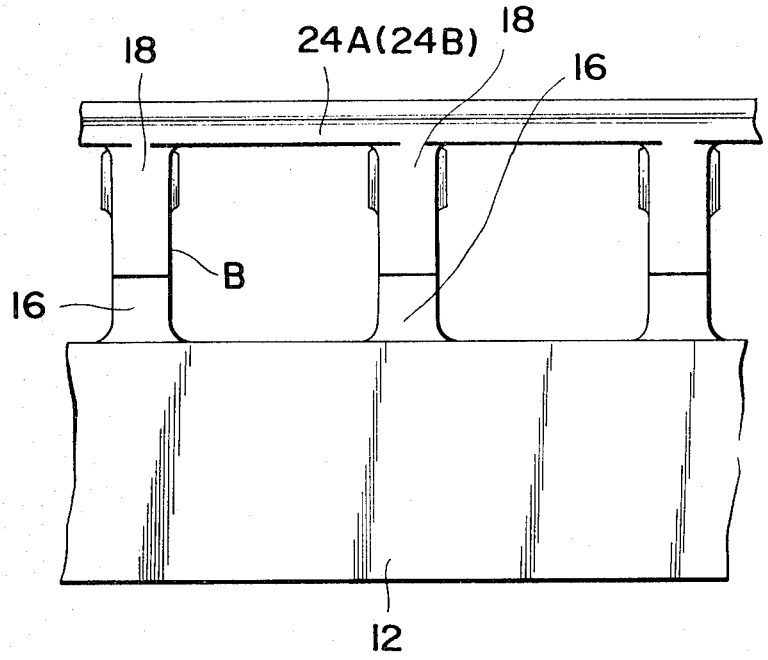
FIG. 3 is a fragmentary side view of a cylinder head of the engine of FIG. 2.

In view of the above description of the conventional overhead camshaft engine, reference is now made to FIGS. 2 and 3, wherein a preferred embodiment of a single overhead camshaft engine of the present invention is illustrated by the reference numeral 10. The engine 10 is, in this instance, used for an automotive vehicle and comprises a cyliinder head 12 secured to the top surface of a cylinder block 14. The cylinder head 12 is formed at its top surface with a plurality of bearing sections 16 which are aligned parallel to each other along the axis of the cylinder head 12 as shown in FIG. 3. A plurality of cam bracket members 18 are secured to the bearing sections 16, respectively, by means of bolts 20. Accordingly, each cam bracket member 18 cooperates with each bearing section 16 to form a camshaft bearing B by which a camshaft 22 is rotatably supported. In other words, the camshaft 22 is rotatably supported between the associated cam bracket member 18 and the bearing section 16 of the cylinder head 12. As a result, the camshaft 22 is rotatably supported by a row of cam bracket members 18 associated with a row of bearing sections 16, in such a manner that the camshaft 22 extends along the axis of the cylinder head 12. Each cam bracket member 18 is generally rectangular in cross-section along an imaginary vertical plane to which the axis of the camshaft 22 is perpendicular The two bolts 20 are located separate from each other and in the vicinity of the opposite side surfaces of the cam bracket member 18 so that the camshaft bearing B is positioned between the two bolts 20 which pass through the cam bracket member 18 to reach the bearing section 16.

Two opposite rigid beam members 24A, 24B are secured to the cam bracket members 18 to securely connect them with each other. The beam members 24A, 24B are connected to the upper opposite corners of each cam bracket member 18 so as to be located outside of the bolts 20. Accordingly, the beam members 24A, 24B are located opposite to each other and extend parallel to each other along the axis of the camshaft 22, so that the plurality of cam brackets 18 are securely connected by the beam members 24A, 24B in the fore-and-aft direction. In this instance, the beam members 24A, 24B are formed integrally with the cam bracket members 18 by casting or the like. Alternatively, the beam members 24A, 24B may be formed separately and independently from the cam bracket members 18, and secured together by means of welding, bolts of the like. The reference numerals 28, 30 denote intake and exhaust parts, respectively, which are, as usual, communicable with a combustion chamber 32.

United States Patent [19]

Burandt

[11] 4,438,735

[45] Mar. 27, 1984

[54] APPARATUS AND TIMING MECHANISM FOR CONTROLLING THE VALVE OPERATION OF AN INTERNAL COMBUSTION ENGINE

[75] Inventor: Corliss O. Burandt, Plymouth, Minn.

[73] Assignee: Investment Rarities, Incorporated, Minneapolis, Minn.

[21] Appl. No.: 310,637

[22] Filed: Oct. 13, 1981

[51] Int. Cl.[3] ..... F01L 1/34

[52] U.S. Cl. ..... 123/90.16; 123/90.31; 123/90.44

[58] Field of Search ..... 123/90.15, 90.16, 90.17, 123/90.27, 90.31, 90.39, 90.44

[56] References Cited

U.S. PATENT DOCUMENTS

| | | | |
|---|---|---|---|
| 2,260,983 | 10/1941 | Walker | 123/90.16 |
| 3,496,918 | 2/1970 | Finlay | 123/90.15 |
| 3,897,760 | 8/1975 | Hisserich | 123/90.16 |
| 3,986,484 | 10/1976 | Dyer | 123/90.15 |
| 4,174,683 | 11/1979 | Vivian | 123/90.15 |

*Primary Examiner*—Craig R. Feinberg

*Assistant Examiner*—W. R. Wolfe

*Attorney, Agent, or Firm*—Peterson, Palmatier, Sturm, Sjoquist & Baker, Ltd.

[57] ABSTRACT

The valve operating apparatus includes an upper and lower rocker arm for each valve to be controlled, each having a straight section and a curved section. The lower rocker arm is mounted at one end for pivotal movement about a fixed axis, its other end acting against the valve to be controlled. The upper rocker arm is mounted at one end for pivotal movement about a shiftable or movable axis. Depending on where the upper rocker arm has been shifted to in relation to the camshaft and concomitantly where the upper arm has been shifted in relation to the lower arm the lift and duration of valve opening is controlled. A timing mechanism is actuated by the valve operating apparatus so as to angularly displace the camshaft on which the above alluded to cam is mounted in a direction to advance or retard the valve opening and closing with respect to the crankshaft and hence in relation to the piston movement produced by the crankshaft.

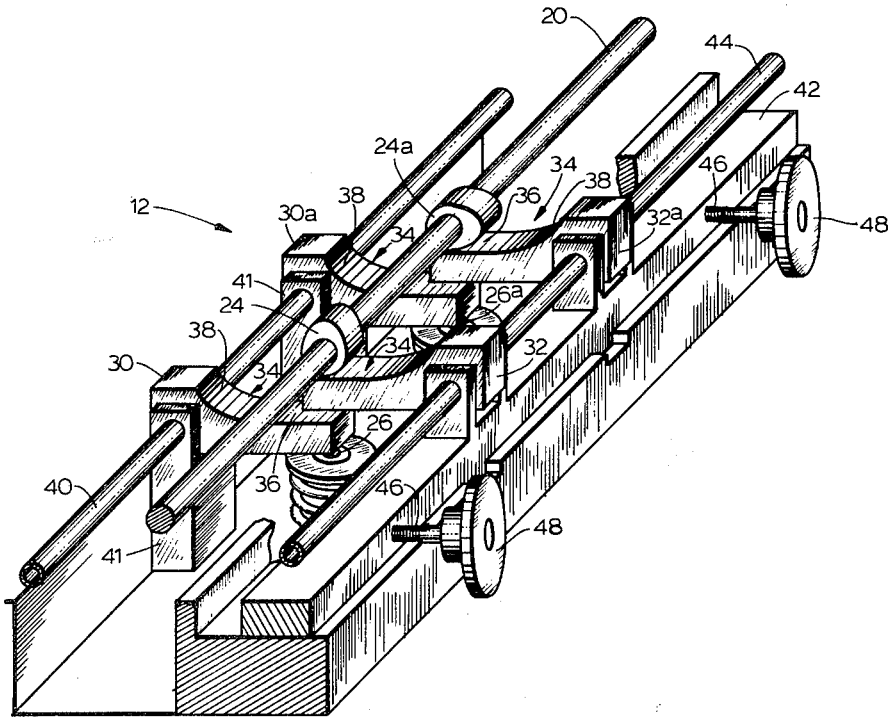

4 Claims, 5 Drawing Figures